US005573902A

United States Patent [19]

Daubendiek et al.

[11] Patent Number: 5,573,902

[45] Date of Patent: Nov. 12, 1996

[54] TABULAR GRAIN EMULSIONS WITH SENSITIZATION ENHANCEMENTS

[75] Inventors: Richard L. Daubendiek; Joseph C. Deaton, both of Rochester; Donald L. Black, Webster; Timothy R. Gersey; Joseph G. Lighthouse, both of Rochester; Myra T. Olm, Webster; Xin Wen; Robert D. Wilson, both of Rochester, all of N.Y.

[73] Assignee: Eastman Kodak Company, Rochester, N.Y.

[21] Appl. No.: 441,491

[22] Filed: May 15, 1995

[51] Int. Cl.[6] ..... G03C 1/035

[52] U.S. Cl. ..... 430/567; 430/569; 430/581

[58] Field of Search ..... 430/567, 569, 430/581

[56] References Cited

U.S. PATENT DOCUMENTS

| | | | |
|---|---|---|---|
| 4,142,900 | 3/1979 | Maskasky | 430/567 |
| 4,814,264 | 3/1989 | Kishida et al. | 430/567 |
| 5,250,403 | 10/1993 | Antoniades et al. | 430/505 |
| 5,252,442 | 10/1993 | Dickerson et al. | 430/502 |
| 5,314,793 | 5/1994 | Chang et al. | 430/506 |
| 5,360,703 | 11/1994 | Chong et al. | 430/506 |
| 5,418,125 | 5/1995 | Maskasky | 430/569 |

FOREIGN PATENT DOCUMENTS

| | | |
|---|---|---|
| 0498302A1 | 8/1992 | European Pat. Off. . |
| 0507702A1 | 10/1992 | European Pat. Off. . |
| 2132372A | 7/1984 | United Kingdom . |

*Primary Examiner*—Lee C. Wright
*Attorney, Agent, or Firm*—Carl O. Thomas

[57] ABSTRACT

A chemically and spectrally sensitized tabular grain emulsion is disclosed including tabular grains (a) having major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (f) exhibiting an average thickness in the range of from less than 0.3 μm to at least 0.07 μm.

It has been observed that increased speed, lower granularity, increased contrast and faster rates of development can be realized when (1) the tabular grains contain less than 10 mole percent iodide and (2) the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the major faces of the tabular grains, (b) containing a silver chloride concentration at least 10 mole percent higher than that of the tabular grains, and (c) including at least 1 mole percent iodide.

14 Claims, No Drawings

TABULAR GRAIN EMULSIONS WITH SENSITIZATION ENHANCEMENTS

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μM and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed. The most highly controlled site depositions (e.g., corner specific epitaxy siting) and the highest reported photographic speeds reported by Maskasky I were obtained by epitaxially depositing silver chloride onto silver iodobromide tabular grains. Although Maskasky I disclosed the epitaxial deposition of silver iodobromide on silver bromide tabular grains (col. 24, lines 37 and 38, Maskasky I taught a preference for epitaxially depositing a silver salt having a higher solubility than the host tabular grains, stating that this reduces any tendency toward dissolution of the tabular grains while silver salt is being deposited (col. 24, lines 10 to 14). Maskasky I recognized that even when chloride is the sole halide run into a tabular grain emulsion during epitaxial deposition, a minor portion of the halide contained in the host tabular grains can migrate to the silver chloride epitaxy. Maskasky I offers as an example the inclusion of minor amounts of bromide ion when silver and chloride ions are being run into a tabular grain emulsion during epitaxial deposition. From the iodide levels contained in the tabular grain emulsions of Maskasky I and the investigations of this invention, reported in the Examples below, it is apparent that the epitaxial depositions of Maskasky I contained only a fraction of a mole percent iodide transferred from the host tabular grains.

Maskasky U.S. Pat. No. 4,471,050, hereinafter referred to as Maskasky II, discloses that nonisomorphic silver salts can be selectively deposited on the edges of silver halide host grains without relying on a supplemental site director. The nonisomorphic silver salts include silver thiocyanate, β phase silver iodide (which exhibits a hexagonal wurtzite type crystal structure), γ phase silver iodide (which exhibits a zinc blende type crystal structure), silver phosphates (including meta- and pyro-phosphates) and silver carbonate. None of these nonisomorphic silver salts exhibit a face centered cubic crystal structure of the type found in photographic silver halides—i.e., an isomorphic face centered cubic crystal structure of the rock salt type. In fact, speed enhancements produced by nonisomorphic silver salt epitaxy have been much smaller than those obtained by comparable isomorphic silver salt epitaxial sensitizations.

RELATED PATENT APPLICATIONS

Daubendiek et al U.S. Ser. No. 08/359,251, filed Dec. 19, 1994, commonly assigned, titled EPITAXIALLY SENSITIZED ULTRATHIN TABULAR GRAIN EMULSIONS, now allowed, (Daubendiek et al I) observed photographic performance advantages to be exhibited by ultrathin tabular grain emulsions that have been chemically and spectrally sensitized, wherein chemical sensitization includes an epitaxially deposited silver salt.

Daubendiek et al U.S. Ser. No. 08/297,430, filed Aug. 26, 1994, commonly assigned, titled ULTRATHIN TABULAR GRAIN EMULSIONS CONTAINING SPEED-GRANULARITY ENHANCEMENTS, now allowed, (Daubendiek et al II) observed in addition to the photographic performance advantages of Daubendiek et al I improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy.

Olm et al U.S. Ser. No. 08/296,562, filed Aug. 26, 1994, commonly assigned, titled ULTRATHIN TABULAR GRAIN EMULSIONS WITH NOVEL DOPANT MANAGEMENT, now allowed, observed an improvement on the emulsions of Daubendiek et al I and II in which a dopant is incorporated in the silver salt epitaxy.

Deaton et al U.S. Ser. No. 08/451,881, concurrently filed and commonly assigned, titled ULTRATHIN TABULAR GRAINS WITH SENSITIZATION ENHANCEMENTS (II), discloses tabular grain emulsions similar to those of this invention, except that the tabular grains having an average thickness of less than 0.07 μm.

PROBLEM TO BE SOLVED

Notwithstanding the many advantages of tabular grain emulsions in-general and the specific improvements to color photographic elements in which they are employed, there has remained an unsatisfied need for performance improvements in tabular grain emulsions heretofore unavailable in the art. Specifically, there has remained a need for tabular grain emulsions that produce a better relationship between speed and granularity, which can be taken in terms of increased speed, lower granularity, or a combination of both. Additionally, it is a problem that increased speed has often been obtained at the expense of contrast. There is a need for speed enhancements that allow contrast to maintained or even increased.

SUMMARY OF THE INVENTION

In one aspect this invention is directed to a radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (e) having an average thickness in the range of from less than 0.3 μm to at least 0.07 μm, (3) latent image forming chemical sensitization sites on the surfaces of the tabular grains, and (4) a spectral sensitizing dye adsorbed to the surfaces of the tabular grains, wherein the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including at least 1 mole percent iodide, based on silver forming the protrusions.

It has been observed quite surprisingly that intentionally increasing the iodide concentrations of silver halide epitaxy containing silver chloride further increases speed and contrast and decreases granularity. This runs exactly contrary to a bias in the art toward maintaining higher levels of iodide in the tabular grains than in associated silver halide epitaxy. It has been discovered that as iodide is increased in the silver halide epitaxy unexpected speed, granularity and contrast improvements can be realized. Further, it is possible for the iodide levels in the epitaxy to exceed those of the tabular grain hosts. Thus, overall reductions in iodide can be realized that permit more rapid processing.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional tabular grain emulsion in which the tabular grains (a) have {111} major faces;

(b) contain greater than 70 mole percent bromide and at least 0.25 mole percent iodide, based on silver;

(c) account for greater than 90 percent of total grain projected area;

(d) exhibit an average equivalent circular diameter (ECD) of at least 0.7 μm; and (e) have an average thickness in the range of from less than 0.3 μm to at least 0.07 μm.

Tabular grain emulsions satisfying criteria (a) through (e) are, apart from their sensitization, which is the subject of this invention, conventional. The following provide illustrative teachings of tabular grain emulsions satisfying these criteria:

Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,672,027;
Sugimoto et al U.S. Pat. No. 4,665,012;
Yamada et al U.S. Pat. No. 4,679,745;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Sutton et al U.S. Pat. No. 5,300,413;
Delton U.S. Pat. No. 5,310,644;
Chang et al U.S. Pat. No. 5,314,793;
Black et al U.S. Pat. No. 5,334,495;
Chaffee et al U.S. Pat. No. 5,358,840; and
Delton U.S. Pat. No. 5,372,927.

In referring to grains and emulsions containing more than one halide, the halides are named in their order of ascending concentration. For camera speed films it is generally preferred that the tabular grains contain at least 0.25 (preferably at least 1.0) mole percent iodide, based on silver. The tabular grains in the emulsions of the invention contain in all instances less than 10 mole percent iodide, preferably less than 6 mole percent iodide, and optimally less than 4 mole percent iodide. It is possible to include minor amounts of chloride ion in the tabular grains. For example, Delton U.S. Pat. No. 5,372,927, cited above, discloses tabular grain emulsions containing from 0.4 to 20 mole percent chloride and up to 10 mole percent iodide, based on total silver, with the halide balance being bromide.

The tabular grains accounting for at least 90 percent of total grain projected area contain at least 70 mole percent bromide and at least 0.25 mole percent iodide, based on silver. These tabular grains include silver iodobromide, silver iodochlorobromide and silver chloroiodobromide grains. All references to the composition of the tabular grains exclude the silver halide epitaxy.

The iodide within the tabular grains can be uniformly or non-uniformly distributed in any conventional manner. For example, the emulsions of Wilgus et al U.S. Pat. No. 4,434,226 and Kofron et al U.S. Pat. No. 4,439,520, cited above, illustrate conventional uniform iodide silver iodobromide tabular grain emulsions. The emulsions of Solberg et al U.S. Pat. No. 4,433,048 and Chang et al U.S. Pat. No. 5,314,793, cited above, illustrate specifically preferred non-uniform iodide placements in silver iodobromide tabular grains that increase photographic speed without increasing granularity. In the tabular grains of the emulsions of the present invention it is specifically preferred that at least the portions of the tabular grains extending between their {111} major faces that form an epitaxial junction with silver halide deposited as a chemical sensitizer contain a lower iodide concentration than the silver halide epitaxy. Most preferably the tabular grains contain a lower concentration throughout than the silver halide epitaxy, and, optimally, the tabular grains contain less total iodide that the silver halide epitaxy.

The tabular grains in the emulsions of the invention all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Tabular grain emulsions in which the tabular grains account for greater than 97 percent of total grain projected area are preferred. Most preferably greater than 99 percent (substantially all) of total grain projected area is accounted for by tabular grains. Emulsions of this type are illustrated, for example, by Tsaur et al and Delton, cited above. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al U.S. Pat. No. 5,250,403, the disclosure of which is here incorporated by reference. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the tabular grain emulsions of the invention the tabular grains accounting for greater than 90 percent of total grain projected area exhibit a mean thickness in the range of from less than 0.3 μm to 0.07 μm. Emulsions with greater tabular grain thicknesses are taught by Kofron et al, cited above, to be useful for recording blue exposures, but they are definitely inferior for recording in the minus blue (i.e., green and/or red) portion of the spectrum. Efficient levels of imaging with lower silver requirements can be realized when average tabular grain thicknesses are maintained less than 0.3 μm and spectral sensitizing dyes are employed. When the tabular grains have a minimum mean thickness of at least 0.07 μm a much wider range of emulsion preparation procedures and conditions are available than are required to produce tabular grain emulsions with mean grain thicknesses of less than 0.07 μm.

Preferred tabular grain emulsions are those in which grain to grain variance is held to low levels. It is preferred that greater than 90 percent of the tabular grains have hexagonal major faces. Preferred tabular grain emulsions exhibit a coefficient of variation (COV) based on ECD of less than 25 percent, most preferably less than 20 percent. COV as herein employed is 100 times the quotient of the standard deviation (σ) of ECD divided by mean ECD.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in tabular grain emulsions of the invention can produce a significant increase in emulsion granularity. A conventional solution is to employ low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to conventional tabular grain precipitation procedures to decrease selectively the size-frequency distribution of the tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of tabular grains having greater than mean ECD's (hereinafter referred to as the $>ECD_{av.}$ grains) can be realized by modifying the procedure for precipitation of the tabular grain emulsions in the following manner: Tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky III), incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky III employ reduce methionine below detectable limits. Examples of agents that have been employed for oxidizing the methionine in gelatino-peptizers include NaOCl , chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R\text{-}SO_{2S}\text{-}M \quad \text{(I)}$$

$$R\text{-}SO_2S\text{-}R^1 \quad \text{(II)}$$

$$R\text{-}SO_2S\text{-}Lm\text{-}SSO_2\text{-}R^2 \quad \text{(III)}$$

Although not essential to the practice of the invention, improvements in photographic performance compatible with the advantages elsewhere described can be realized by incorporating a dopant in the tabular grains. As employed herein the term "dopant" refers to a material other than a silver or halide ion contained within the face centered cubic crystal lattice structure of the silver halide forming the tabular grains.

Any conventional dopant known to be useful in a silver halide face centered cubic crystal lattice structure can be employed. Photographically useful dopants selected from a wide range of periods and groups within the Periodic Table of Elements have been reported. As employed herein, references to periods and groups are based on the Periodic Table of Elements as adopted by the American Chemical Society and published in the *Chemical and Engineering News*, Feb. 4, 1985, p. 26. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering*, Vol. 24, No. 6, Nov./Dec. 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EPO 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320. Olm et al U.S. Pat. No. 5,360,712, the disclosure of which is here incorporated by reference, discloses hexacoordination complexes containing organic ligands while Bigelow U.S. Pat. No. 4,092,171 discloses organic ligands in Pt and Pd tetra-coordination complexes.

It is specifically contemplated to incorporate in the tabular grains a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant during silver halide precipitation.

In another specifically preferred form of the invention it is contemplated to incorporate in the face centered cubic crystal lattice of the tabular grains a dopant capable of increasing photographic speed by forming shallow electron traps. *Research Disclosure*, vol. 367, Nov. 1994, Item 36736, contains a comprehensive description of the criteria for selecting shallow electron trapping (SET) dopants.

In a specific, preferred form it is contemplated to employ as a dopant a hexacoordination complex satisfying the formula:

$$[ML_6]^n \qquad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the tabular grains and the remainder is incorporated in the silver halide protrusions.

The chemical and spectral sensitizations of this invention improve upon the best chemical and spectral sensitizations disclosed by Maskasky I. That is, in the practice of the present invention tabular grains receive during chemical sensitization epitaxially deposited silver halide forming protrusions at selected sites on the tabular grain surfaces. Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host tabular grains. It would be more precise to reference the higher chloride concentration in the silver halide protrusions to the chloride ion concentration in the epitaxial junction forming portions of the tabular grains, but this is not necessary, since the chloride ion concentrations of the tabular grains are contemplated to be substantially uniform (i.e., to be at an average level) or to decline slightly due to iodide displacement in the epitaxial junction regions.

Contrary to the teachings of Maskasky I, it has been found that improvements in photographic performance can be realized by adding iodide ions along with silver and chloride ions to the tabular grain emulsions while performing epitaxial deposition. Specifically, inclusion in the silver chloride containing epitaxy of at least 1 mole percent iodide is contemplated. Preferably the silver chloride containing epitaxy contains at least a 1 mole higher iodide concentration than is present in at least those portions of the tabular grains extending between their {111} major faces and forming epitaxial junctions with the protrusions. When the tabular grains contain a uniform distribution of iodide, the epitaxially deposited protrusions contain a higher (preferably at least 1 mole percent higher) iodide concentration than the average iodide concentration of the tabular grains. Further, it is possible to achieve superior performance with lower total levels of iodide in the emulsions, which in turn results in higher rates of development.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603 (hereinafter referred to as Maskasky IV and V). Precipitation at ambient pressure, which is universally practiced in the art, limits iodide inclusion in a silver chloride crystal lattice to less than 13 mole percent. For example, introducing silver along with an 84:16 chloride:iodide molar ratio during silver halide epitaxial deposition resulted in an iodide concentration in the resulting epitaxial protrusions of less than 2 mole percent, based on silver in the protrusions. By displacing a portion of the chloride with bromide much higher levels of iodide can be introduced into the protrusions. For example, introducing silver along with a 42:42:16 chloride:bromide:iodide molar ratio during silver halide epitaxial deposited resulted in an iodide concentration in the resulting epitaxial protrusions of 7.1 mole percent, based on silver in the protrusions. Preferred iodide ion concentrations in the protrusions are in the range of from 1 to 15 mole percent (most preferably 2 to 10 mole percent), based on silver in the protrusions.

It has been discovered quite unexpectedly that further improvements in speed-granularity relationships can be realized by introducing along with silver ions during epitaxial deposition chloride, bromide and iodide ions. Since silver bromide and iodobromide epitaxy on silver iodobromide host tabular grains produces lower levels of sensitization than concurrent introductions of silver, chloride and iodide ions during epitaxy, it was unexpected that displacement of a portion of the chloride with bromide would further increase photographic performance. Analysis indicates that the introduction of chloride and bromide ions during precipitation of the epitaxial protrusions facilitates higher iodide incorporations. This can be explained in terms of the increased crystal cell lattice dimensions imparted by the increased levels of bromide ions. It does not explain why photographic performance increased rather than declining to more closely approximate that imparted by silver iodobromide epitaxial protrusions.

It is believed that the highest levels of photographic performance are realized when the silver halide epitaxy contains both (1) large differences in chloride concentrations between the host tabular grains and the epitaxially deposited protrusions noted above and (2) elevated levels of iodide inclusion in the face centered cubic crystal lattice structure of the protrusions.

One preferred technique relevant to objective (1) is to introduce the different halide ions during precipitation of the protrusions in the order of descending solubilities of the silver halides that they form. For example, if chloride, bromide and iodide ions are all introduced during precipitation of the protrusions, it is preferred to introduce the chloride ions first, the bromide ions second and the iodide ions last. Because silver iodide is less soluble than silver bromide which is in turn less soluble than silver chloride, the sequential order of halide ion addition preferred gives the chloride ion the best possible opportunity for deposition adjacent the junction. A clear stratification of the protrusions into regions exhibiting higher and lower chloride ion concentrations can in some instances be detected, but may not be detectable in every instance in which the preferred sequential halide addition is employed, since both bromide and iodide ions have the capability of displacing chloride to some extent from already precipitated silver chloride.

Increasing iodide levels in the protrusions runs directly contrary to a prior belief in the art that iodide in epitaxially deposited protrusions should be minimized to avoid morphological instability in the host tabular grains. However, it has been observed that increased iodide concentrations in the epitaxially deposited protrusions as described above is not incompatible with maintaining the tabular configuration of the host grains.

In the practice of the invention the elevated iodide concentrations in the protrusions are those that can be accommodated in a face centered cubic crystal lattice structure of the rock salt type—that is, the type of isomorphic crystal lattice structure formed by silver and one or both of chloride and bromide. It is, of course, possible to incorporate limited amounts (generally cited as 10 mole percent or less) of bromide and/or chloride ions into nonisomorphic β or γ phase silver iodide crystal structures; however, nonisomorphic silver halide epitaxy forms no part of this invention.

The structures are too divergent to ascribe similar photographic properties, and nonisomorphic epitaxial protrusions have been demonstrated by Maskasky II to produce much lower levels of sensitization than isomorphic crystal structure silver halide epitaxial protrusions.

Subject to the composition modifications specifically described above, preferred techniques for chemical and spectral sensitization are those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area. It is contemplated to restrict silver halide epitaxy to those portions nearest peripheral edges of and accounting for less than 50 percent of the {111} major faces of the tabular grains and, preferably, to a much smaller percent of the {111} major faces of the tabular grains, preferably less than 25 percent, most preferably less than 10 percent, and optimally less than 5 percent of the {111} major faces of the host tabular grains. It is preferred to restrict the silver halide epitaxy to those portions of the tabular grains that are formed by the laterally displaced regions, which typically includes the edges and corners of the tabular grains.

Like Maskasky I, nominal amounts of silver halide epitaxy (as low as 0.05 mole percent, based on total silver, where total silver includes that in the host and epitaxy) are effective in the practice of the invention. It is preferred that the silver halide epitaxy be limited to less than 50 percent of total silver. Generally silver halide epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver halide epitaxy that can be applied in forming the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the tabular grains is more efficient than that overlying all or most of the major faces, still better is epitaxy that is substantially confined to the edges of the host tabular grains, with limited coverage of their major faces, and still more efficient is epitaxy that is confined at or near the corners or other discrete sites of the tabular grains. The spacing of the corners of the major faces of the host tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. When the host tabular grains contain a higher iodide concentration in laterally displaced regions, as taught by Solberg et al, cited above, it is recognized that enhanced photographic performance is realized by restricting silver halide protrusions to the higher iodide laterally displaced regions.

The dopants described above in connection with the tabular grains can alternatively be wholly or partly located in the silver halide epitaxy.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in Research Disclosure, Vol. 365, Sept. 1994, Item 36544, Section IV. Chemical sensitization. Kofron et al illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

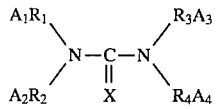

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$or $R_3$ and $R_4$ complete a 5 to 7 member heterocyclic ring; and each of $A_1$, $A_2$, $A_3$ and $A_4$, can independently represent hydrogen or a radical comprising an acidic group, with the proviso that at least one $A_1R_1$ to $A4R_4$contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IV)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by Kofron et al, particularly the blue spectral sensitizing dyes shown by structure and their longer methane chain analogous that exhibit absorption maxima in the green and red portions of the spectrum, are particularly preferred for incorporation in the tabular grain emulsions of the invention. The selection of Jaggregating blue absorbing spectral sensitizing dyes for use as site directors is specifically contemplated. A general summary of useful spectral sensitizing dyes is provided by *Research Disclosure*, Item 36544, Section V. Spectral sensitization and desensitization, A. Sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an tabular grain according to the invention after chemical sensitization has been completed.

Aside from the features of spectral sensitized, silver halide epitaxy sensitized tabular grain emulsions described above, the emulsions of this invention and their preparation can take any desired conventional form. For example, in accordance with conventional practice, after a novel emulsion satisfying the requirements of the invention has been prepared, it can be blended with one or more other novel emulsions according to this invention or with any other conventional emulsion. Conventional emulsion blending is illustrated in *Research Disclosure*, Item 36544, Section I, E. Blends, layers and performance categories, the disclosure of which is here incorporated by reference.

The emulsions once formed can be further prepared for photographic use by any convenient conventional technique. Additional conventional features are illustrated by *Research Disclosure* Item 36544, cited above, Section II, Vehicles, vehicle extenders, vehicle-like addenda and vehicle related addenda; Section III, Emulsion washing; Section V, Spectral sensitization and desensitization; Section VI, UV dyes/optical brighteners/luminescent dyes; Section VII, Antifoggants and stabilizers; Section VIII, Absorbing and scattering materials; Section IX, Coating physical property modifying addenda; Section X, Dye image formers and modifiers. The features of Sections VI, VIII, IX and X can alternatively be provided in other photographic element layers. Other features which relate to photographic element construction are found in Section XI, Layers and layer arrangements; XII, Features applicable only to color negative; XIII, Features applicable only to color reversal; XIV, Scan facilitating features; and XV, Supports.

The novel epitaxial silver halide sensitized tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast is measured as mid-scale contrast. Halide ion concentrations are reported as mole percent (M%), based on silver.

Emulsion A

This emulsion was precipitated in a two part process. Part 1 effected the formation of nine moles of a Ag(Br, I) emulsion having mean diameter and thickness values of ca. 1.9 μm and 0,047 μm, respectively. A portion of this emulsion was then used as a seed emulsion for further growth in Part 2, during which additionally precipitated silver bromide was deposited mainly on the {111} major faces of the tabular grains—i.e., thickness rather than lateral growth was fostered in Part 2 of the precipitation.

Part 1

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous, 4 second addition of $AgNO_3$ and halide (98.5 and 1.5 M% NaBr and KI, respectively) solutions, both at 2.5 M, in sufficient quantity to form 0.01335 mole of silver iodobromide, pBr and pH remained approximately at the values initially set in the reactor solution. Following nucleation, the reactor gelatin was quickly oxidizedby addition of 128 mg of Oxone™ ($2KHSO_5 \cdot KHSO_4 \cdot K_2SO_4$, purchased from Aldrich) in 50 mL of water, and the temperature was raised to 54° C. in 9 min. After the reactor and its contents were held at this temperature for 9 min, 100 g of oxidized methionine lime-processed bone gelatin dissolved in 1.5 L $H_{20}$ at 54° C. were added to the reactor. Next the pH was raised to 5.90, and 43.75 mL of 2.8 M NaBr were added to the reactor. Twenty five minutes after nucleation the growth stage was begun during which 2.5 M $AgNO_3$, 2.8 M NaBr, and a 0.108 M suspension of AgI (Lippmann) were added in proportions to maintain (a) a uniform iodide level of 4.125 M % in the growing silver halide crystals and (b) the reactor pBr at the value resulting from the cited NaBr additions prior to the start of nucleation and growth, until 0.813 mole of silver iodobromide had formed, at which time the excess $Br^-$ concentration was increased by addition of 37.5 mL of 2.8 M NaBr; the reactor pBr was maintained at the resulting value for the balance of the growth. The flow of the cited reactants was then resumed and the flow was accelerated such that the final flow rate at the end of growth, which took at total of 127 minutes, was approximately 13 times that at the beginning; a total of 9 moles of silver iodobromide (4.125 M % I) was formed.

Part 2

Six moles of the emulsion formed in Step 1 were removed, and additional growth was carried out on the 3 moles which were retained in the reactor and which served as seed crystals for further thickness growth. Before initiating this additional growth, 34 grams of oxidized, lime-processed bone gelatin, dissolved in 500 mL water at 54° C., were added and the reactor pBr was adjusted to ca. 2.05 by slow addition of $AgNO_3$. Next, growth was begun using double jet addition of 3.0 M AgNO3 and 5.0 M NaBr with relative rates such that the reactor pBr was further adjusted to 3.3 over the next 10 min. While maintaining this high pBr value and a temperature of 54° C., growth was continued by adding the cited $AgNO_3$ and NaBr solutions until an additional 9.0 moles of silver bromide was deposited onto the host grains; flow rates were accelerated 1.85× during the 162 min growth of Part 2.

The final overall composition of the resulting silver iodobromide tabular grain emulsion was ca. 98.97 M % Br and 1.03 M % I. When growth was completed, pBr was lowered to ca. 2, and the emulsion was coagulation washed. After washing, pH and pBr were adjusted to 6.0 and 3.1, respectively, prior to storage.

The resulting emulsion was examined by scanning electron microscopy (SEM) and mean grain area was determined from the resulting grain pictures using a *Summagraphics SummaSketch Plus* sizing tablet that was interfaced to an IBM Personal Computer: More than 98% of total grain projected area were provided by tabular crystals. The mean ECD of the emulsion grains was 1.37 μm (coefficient of variation=43). During Part 2 the mean ECD of the tabular grain emulsion was actually reduced from its value at the end of Part 1. Assuming a constant number of particles, this indicated that negative lateral growth occurred, suggesting that ripening had occurred at the edges of the tabular grains and that deposition of silver halide had occurred primarily on the {111} major faces of the tabular grains. Since the grain population of the final emulsion consisted almost exclusively of tabular grains, the grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole cm and its site area per molecule to be 0,566 $nm^2$. This approach gave a mean grain thickness of 0.175 μm.

Epitaxial Sensitizations

Samples of the emulsion were next sensitized with silver salt epitaxy being present, with the nominal epitaxy composition being silver chloride, silver iodochloride or silver iodobromochloride.

Control

A 0.5 mole sample of Emulsion A was melted at 40° C. and its pBr was adjusted to ca. 4 with a simultaneous addition of $AgNO_3$ and KI solutions in a ratio such that the small amount of silver halide precipitated during this adjustment was 12% I. Next, 2 M% NaCl (based on the original amount of silver iodobromide host) was added, followed by addition of spectral sensitizers Dye 1 [anhydro-9-ethyl-5', 6'-dimethyoxy-5-phenyl-3'-(3-sulfopropyl)-3-(3-sulfobutyl)oxathiacarbocyanine hydroxide] and Dye 2 [anhydro-5,5'-dichloro-9-ethyl-3,3'-bis(3-sulfopropyl)thiacarbocyanine hydroxide, sodium salt], after which 6 M % AgCl epitaxy was formed by sequential addition of $CaCl_2$ and $AgNO_3$ solutions. This procedure produced epitaxial growths mainly on the corners and edges of the host tabular grains. The epitaxy amounted to 6 M % of the silver in the starting tabular grain emulsion. The nominal composition of the tabular grain host—that is, the halide added to form the host grains, and the actual composition of the host grains are set out in Table I. The nominal composition of the epitaxy and the actual composition of the epitaxy are set out in Table II.

Example 1

The epitaxial sensitization procedure employed for the Epitaxial Control was repeated, except that $CaCl_{12}$, AgI (Lippmann) and $AgNO_3$ were added in that order. The total amount of silver added was maintained at 6 M %, based on tabular grain silver. The nominal composition of the tabular grain host and the actual composition of the host grains are set out in Table I. The proportions of the chloride and iodide epitaxy are set out in Table II as nominal (added) and actual (found) AgCl and AgI compositions.

Example 2

The epitaxial sensitization procedure of Example 1 was repeated, except that $CaCl_{12}$, NaBr, AgI (Lippmann) and $AgNO_3$ were added in that order. Thus, chloride, bromide and iodide were added in sequence. The total amount of silver precipitated was maintained at 6 M % of the tabular grain silver. The nominal composition of the tabular grain host and the actual composition of the host grains are set out in Table I. The proportions of the chloride, bromide and iodide in the epitaxy are set out in Table II as nominal and actual AgCl, AgBr and AgI compositions.

Analytical electron microscopy (AEM) techniques were employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron. Microcopy*/1977; Vol. 1, IIT Research Institute, March 977, p. 651. The composition of an individual epitaxial protrusion was determined by focusing an electron beam to a size small enough to irradiate only the protrusion being examined. The selective location of the epitaxial protrusions at the corners and edges of the host tabular grains facilitated addressing only the epitaxial protrusions. Each corner epitaxial protrusion on each of 25 grains was examined for each of the sensitizations. The results are summarized in Tables I and II.

TABLE I

| | Halide in Tabular Grains | | | |
|---|---|---|---|---|
| | Halide | Halide Found (Std. Dev.) | | |
| Sample | Added | Cl | Br | I |
| Cont. | Br 99% | 4.7% | 93.9% | 1.3% |
| | I 1% | (0.3) | (0.4) | (0.2) |
| Ex. 1 | Br 99% | 4.7% | 93.7% | 1.6% |
| | I 1% | (0.4) | (0.6) | (0.1) |
| Ex. 2 | Br 99% | 4.6% | 93.9% | 1.5% |
| | I 1% | (0.4) | (0.6) | (0.2) |

TABLE II

| | Halide in Epitaxy | | | |
|---|---|---|---|---|
| | Halide | Halide Found (Std. Dev.) | | |
| Sample | Added | Cl | Br | I |
| Cont. | Cl 100% | 65.6% | 34.4% | 0% |
| | | (5.4) | (5.4) | |
| Ex. 1 | I 16% | 81.2% | 17.7% | 1.1% |
| | Cl 84% | (4.4) | (4.1) | (0.7) |
| Ex. 2 | Cl 42% | | | |
| | Br 42% | 39.8% | 54.6% | 5.6% |
| | I 16% | (9.9) | (9.1) | (1.6) |

The minimum AEM detection limit was a halide concentration of 0.5 M %.

From Table II, referring to the Control, it is apparent that, when chloride was the sole halide added to the silver iodobromide tabular grain emulsion during precipitation of the epitaxial protrusions, migration of iodide ion from the host tabular grains was essentially non-existent (below the detection limit). When 16 M % iodide and 84 M % chloride were added to form the epitaxy, the iodide level in the epitaxy increased to just over 1 mole percent, based on silver forming the epitaxial protrusions. When bromide as well as chloride were precipitated with a nominal 16 M % iodide, iodide incorporation in the epitaxial protrusions were increased to over 5 mole percent.

Post-Epitaxy Preparation

The epitaxially sensitized emulsions were each divided into smaller portions to determine optimal levels of subsequently added sensitizing components and to test effects of level variations. To these portions were added additional portions of Dyes 1 and 2, 60 mg NaSCN/mole Ag, sulfur Sensitizer 1, gold Sensitizer 2, and 11.44 mg 1-(3-acetamidophenyl)-5-mercaptotetrazole (APMT)/mole Ag. After all components were added the 20 mixture was heated to 50° C. to complete the sensitization, and after cool-down, 114.4 mg additional APMT was added.

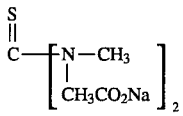

Sensitizer 1

-continued

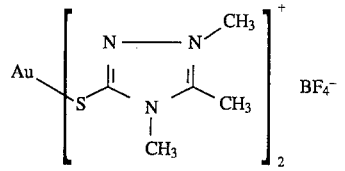

Sensitizer 2

Based on photographic element constructions and sensitometric evaluations identical to those reported below using portions of the emulsions, the optimum levels of Dyes 1 and 2 in each of the Control, Example 1 and Example 2 emulsions were determined to be 87.7 and 358.7 mg/mole Ag, respectively. Optimum levels of Sensitizers 1 and 2 in mg/mole Ag were determined to be 3.1 and 0.9 (Control), 1.5 and 0.9 (Example 1) and 2.7 and 0.8 (Example 2), respectively.

The resulting optimally sensitized emulsions were coated on a cellulose acetate film support over a gray silver antihalation layer, and the emulsion layer was overcoated with a 4.3 g/m$^2$ gelatin layer containing surfactant and 1.75 percent by weight, based on total Weight of gelatin, of bis(vinylsulfonyl)methane hardener. Emulsion laydown was 0.646 g Ag/m$^2$ and this layer also contained 0.323 g/m$^2$ and 0.019 g/m$^2$ of Couplers 1 and 2, respectively, 10.5 mg/m$^2$ of 4-hydroxy-6-methyl-1,3,3*a*,7-tetraazaindene (Na$^+$salt), and 14.4 mg/m$^2$ 2-(2-octadecyl)-5-sulfohydroquinone (Na$^+$ salt), surfactant and a total of 1.08 g gelatin/m$^2$.

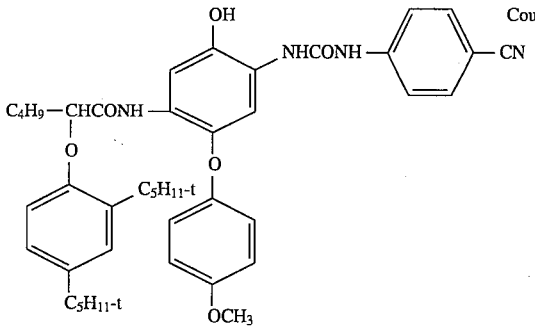

Coupler 1

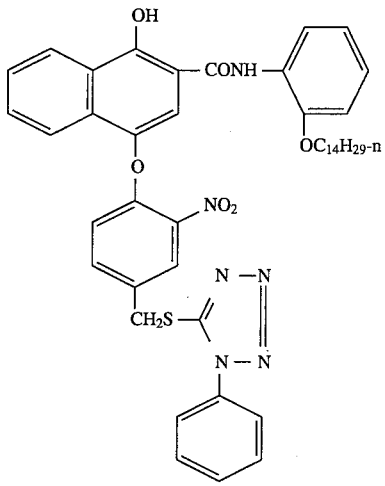

Coupler 2

Sensitometry

The emulsions so coated were given 0.01 sec Wratten 23A ™ filtered (wavelengths >560 nm transmitted) daylight balanced light exposures through a calibrated neutral step tablet, and then were developed using the color negative Kodak Flexicolor™ C41 process. Speed was measured at a density of 0.15 above minimum density.

Granularity measurements were made according to the procedures described in the *SPSE Handbook of Photographic Science and Engineering*, W. Thoma s, Ed., pp. 934–939. The granularity readings at each step were divided by the gamma (ΔD+Δlog E, where D=density and E=exposure in lux-seconds) at each step and plotted vs. log E. In these plots there is typically a minimum. The minimum of this gamma-normalized granularity allows a comparison of coatings having differing contrast. Lower values indicate lower granularity. Granularity readings reported were averages of observations from four adjacent exposure steps near the speed point and extending to higher exposure levels. These four readings were typically near the minimum granularity.

The contrast normalized granularities obtained as described above are reported in Table III below in grain units (g.u.), in which each g.u. represents a 5 percent change; positive and negative changes correspond to grainier and less grainy images, respectively. In other words, negative differences in granularity, indicate granularity reductions.

The results are summarized in Table III.

TABLE III

| Sample | Epitaxy Halide Added | Dmin | Relative Log Speed | Midscale Contrast | Δ Normalized Granularity (g.u.) |
|---|---|---|---|---|---|
| Cont. | Cl 100% | 0.18 | 100 | 0.48 | Check |
| Ex. 1 | Cl 84%<br>I 16% | 0.19 | 127 | 0.62 | −5.5 |
| Ex. 2 | Cl 42%<br>Br 42%<br>I 16% | 0.15 | 115 | 0.66 | −11.9 |

From Table III it is apparent that increasing the concentration of iodide in the epitaxy increases speed, increases midscale contrast, and reduces granularity while minimum density remains fully acceptable.

In comparing Examples 1 and 2, the Example 2 emulsion, having the higher iodide level in the epitaxial protrusions, was superior to the Example 1 emulsion. Applying the generally accepted standard that each 7 g.u. reduction in granularity costs 30 speed units, it is noted that the Example 2 emulsion exhibited a 6.4 g.u. superiority over the Example 1 emulsion, but exhibited only a 12 speed unit lower speed, compared to a 27 speed unit speed reduction that represents an equivalent speed-granularity relationship.

Emulsion B

The evaluations described above were repeated as indicated below, except that the host tabular grain emulsion was a silver iodobromide emulsion containing 4.125 M % iodide, a mean ECD of 1.76 μm (COV=44), and a mean grain thickness of 0,130 μm. Also, NaCl rather than $CaCl_2$ was used to form epitaxial protrusions.

Two emulsions, Control 2 and Example 3, were prepared with epitaxial depositions undertaken as described for Control and Example 2, respectively. Optimum levels of Dyes 1 and 2 were 132.4 and 542.8 mg/mole Ag, respectively, for Control 2 and 145.6 and 597 mg/mole Ag, respectively, for Example 3. Optimum levels of Sensitizers 1 and 2 (mg/Ag mole) were 2.4 and 0.97, respectively, for Control 2 and 2.7 and 1.08, respectively, for Example 3.

The performance results are summarized below in Table IV.

TABLE IV

| Sample | Epitaxy Halide Added | Dmin | Relative Log Speed | Midscale Contrast | Δ Normalized Granularity (g.u.) |
|---|---|---|---|---|---|
| Cont. 2 | Cl 100% | 0.19 | 100 | 0.69 | Check |
| Ex. 3 | Cl 42%<br>Br 42%<br>I 16% | 0.18 | 99 | 0.77 | −7.6 |

From Table IV it is apparent that the higher iodide concentration in the epitaxial protrusions again produced superior performance.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains, tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (e) exhibiting an average thickness in the range of from less than 0.3 μm to at least 0.07 μm, (3) latent image forming chemical sensitization sites on the surfaces of the tabular grains, and (4) a spectral sensitizing dye adsorbed to the surfaces of the tabular grains, wherein the tabular grains contain less than 10 mole percent iodide and the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including at least 1 mole percent iodide, based on silver forming the protrusions.

2. An emulsion according to claim 1 wherein said protrusions contain a higher iodide concentration than those portions of the tabular grains with which the protrusions form epitaxial junctions.

3. An emulsion according to claim 2 wherein said tabular grains contain less than 4 mole percent iodide.

4. An emulsion according to claim 1 wherein said protrusions contain from 1 to 15 mole percent iodide.

5. An emulsion according to claim 4 wherein said protrusions contain from 2 to 10 mole percent iodide.

6. An emulsion according to claim 1 wherein said protrusions contain least 15 mole percent higher chloride ion concentrations than said tabular grains.

7. An emulsion according to claim 6 wherein said protrusions contain at least 20 mole percent higher chloride ion concentrations than said tabular grains.

8. An emulsion according to claim 1 wherein said protrusions account for from 0.3 to 25 percent of total silver.

9. An emulsion according to claim 1 where the epitaxially deposited silver halide protrusions are located on less than 25 percent of the tabular grain surfaces.

10. An emulsion according to claim 9 wherein the epitaxially deposited silver halide protrusions are predominantly located adjacent at least one of the edges and corners of the tabular grains.

11. An emulsion according to claim 1 wherein the tabular grains account for greater than 97 percent of total grain projected area.

12. An emulsion according to claim 1 wherein the spectral sensitizing dye exhibits an absorption peak at wavelengths longer than 430 nm.

13. An emulsion according to claim 12 wherein the spectral sensitizing dye is a J-aggregated cyanine dye.

14. A radiation-sensitive emulsion comprised of (1) a dispersing medium, (2) silver halide grains including tabular grains, tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (e) exhibiting an average thickness in the range of from less than 0.3 μm to at least 0.07 μm, (3) epitaxially deposited silver halide protrusions forming surface chemical sensitization sites on the tabular grains, and (4) a spectral sensitizing dye adsorbed to the surfaces of the tabular grains, wherein the tabular grains contain less than 10 mole percent iodide and the epitaxially deposited silver halide protrusions forming surface chemical sensitization sites include a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains and (b) containing coprecipitated silver chloride and silver iodide, the silver chloride being incorporated in the protrusions in a concentration at least 10 mole percent higher than that of the tabular grains and the silver iodide being incorporated in the protrusions in a concentration of at least 1 mole percent iodide, based on silver forming the protrusions.

* * * * *